US008276428B2

(12) United States Patent
Brüggenbrock et al.

(10) Patent No.: US 8,276,428 B2
(45) Date of Patent: Oct. 2, 2012

(54) DEVICE FOR MANUFACTURING PROFILES

(75) Inventors: Michael Brüggenbrock, Rosendahl (DE); Thomas Flehmig, Ratingen (DE); Mohamed Tohfa, Duisburg (DE); Alexander Herold, Altenkunstadt (DE); Peter Münchenbach, Weismain (DE); Joachim Raps, Burgkunstadt (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 347 days.

(21) Appl. No.: 12/598,900

(22) PCT Filed: Apr. 25, 2008

(86) PCT No.: PCT/EP2008/055073

§ 371 (c)(1),
(2), (4) Date: Apr. 20, 2010

(87) PCT Pub. No.: WO2008/135415

PCT Pub. Date: Nov. 13, 2008

(65) Prior Publication Data

US 2010/0251795 A1 Oct. 7, 2010

(30) Foreign Application Priority Data

May 7, 2007 (DE) ..... 10 2007 021 798

(51) Int. Cl.
*B21D 7/06* (2006.01)

(52) U.S. Cl. ..... 72/389.1

(58) Field of Classification Search ..... 72/389.1, 72/348, 380, 381, 383, 384, 370.12
See application file for complete search history.

(56) References Cited

U.S. PATENT DOCUMENTS

| | | | | |
|---|---|---|---|---|
| 7,401,490 | B2 * | 7/2008 | Copeland et al. | 72/389.1 |
| 2004/0040363 | A1 * | 3/2004 | Takamatu | 72/389.1 |
| 2009/0114703 | A1 | 5/2009 | Brüggenbrock et al. | 228/150 |

FOREIGN PATENT DOCUMENTS

| | | |
|---|---|---|
| DE | 102004046687 | 6/2006 |
| FR | 675967 | 2/1930 |
| GB | 1 290 952 | 9/1972 |
| JP | 53088058 | 8/1978 |
| JP | 2006 247742 | 9/2006 |
| JP | 2006247742 | 9/2006 |

OTHER PUBLICATIONS

International Search Report for International Application No. PCT/EP2008/055073.

* cited by examiner

*Primary Examiner* — Faye Francis
(74) *Attorney, Agent, or Firm* — Proskauer Rose LLP

(57) ABSTRACT

A device for manufacturing profiles from a sheet includes at least one work station with a base plate and two die halves, wherein the die halves and the base plate extend in the longitudinal direction of the profile to be manufactured, and the die halves are arranged on the base plate movable relative to one another perpendicular to the longitudinal direction of the profile. A generic device and method for manufacturing profiles with which even heavily structured profiles can be economically produced with high flexibility, is provided by a punch for forming the sheet. The punch is movable perpendicular to the relative movement of the die halves and perpendicular to the longitudinal extension of the profile to be manufactured. The base plate has a die adapted to the punch, in which the sheet is formed, and the die of the base plate and the punch pertaining to it are exchangeable.

19 Claims, 5 Drawing Sheets

DEVICE FOR MANUFACTURING PROFILES

CROSS-REFERENCE TO RELATED APPLICATIONS

This application is a National Phase Application of International Application No. PCT/EP2008/055073, filed on Apr. 25, 2008, which claims the benefit of and priority to German patent application no. DE 10 2007 021 798.8-14, filed on May 7, 2007. The disclosures of the above applications are incorporated herein by reference in their entirety.

FIELD OF THE INVENTION

The invention relates to a device for manufacturing profiles from a sheet comprising at least one work station with a base plate and two die halves, wherein the die halves and the base plate extend in the longitudinal direction of the profile to be manufactured, the die halves are arranged on the base plate movable relative to one another perpendicular to the longitudinal direction of the profile to be manufactured. In addition to this, the invention relates to a method for manufacturing a profile using the device according to the invention.

BACKGROUND

In the motor vehicle manufacture sector, open profiles and profiles welded to one another are increasingly being replaced by thin-walled hollow profiles, the initial form of which is a tube welded along a longitudinal seam. In order to meet the demands of the motor vehicle manufacturing sector for the lowest possible weight and maximum rigidity and strength, the components have on the one hand a particularly low wall thickness and, on the other hand, frequently have a complex shaping. Through the complex shaping, the profiles are adapted exactly to the specific application. In order to economically manufacture hollow profiles or profiles which are formed for specific applications, particularly good monitoring of the manufacturing process is therefore required. The discontinuous mode of work, by forming finished cut-to-size sheets or blanks, has proved its worth in this respect. For example, from the German Patent Specification DE 10 2004 046 687 B3 a method and a device for manufacturing hollow profiles with welded longitudinal seams are known, in which a sheet blank is bent, by relative movements of die halves, freely about a mould core, positioned between the die halves and extending in the longitudinal direction of the sheet blank, the outer form of which mould core determines the inner form of the hollow profile to be manufactured, and the slot profile obtained in this way is then finish-formed over the die halves and the mould core. With this method of manufacture, designated as the rolling-in technique, complex shapings of the hollow profiles can be manufactured only using elaborate mould cores. In particular, the large drawing depths which are frequently needed for complex shaping cannot be achieved by mould cores, or only with difficulty.

SUMMARY OF THE INVENTION

In general, an aspect of the present invention is to provide a generic device and a method for manufacturing profiles, with which even heavily structured profiles can be manufactured economically and with high flexibility.

According to the invention, the aspect described for a corresponding device is achieved in that a punch, movable perpendicular to the relative movement of the die halves and perpendicular to the longitudinal extension of the profiles to be manufactured, is provided for forming the sheet, the base plate movable relative to the die halves has a die adapted to the punch, in which die the sheet is formed, and the die of the base plate and the punch pertaining to it are exchangeable.

By contrast with the previously known prior art, the device according to the invention has a movable punch, which together with the die of the base plate is exchangeable. As a result, the flexibility in the forming of the profiles is considerably increased, since it is not the mould core which is used for forming or embossing the sheet, but a punch, which extends in the longitudinal direction of the profile to be manufactured. The punch can achieve large drawing depths with a relatively simple design and therefore guarantees the manufacturing of heavily structured profiles with little effort. The exchangeability of the dies and the punch makes it possible for profiles with different shapings to be manufactured from a sheet with the same device. Sheets in the sense of the present invention are plates, sheet blanks, a plurality of individual sheets, or "tailored blanks" Profiles in the sense of the present invention are understood to be profiles with welded longitudinal seams (such as hollow profiles), open profiles (such as half-shells) and partially open profiles. The die halves are to be understood in the sense of the forming tools of the device.

According to a first embodiment of the device according to the invention, the base plate and at least one of the die halves is movable relative to one another and perpendicular to the longitudinal axis of the profile to be manufactured, wherein optionally one die half is designed to be fixed in position. As a result, the device according to the invention can be structured more simply, since drive units, in particular the entire hydraulics for the fixed die half, can be dispensed with.

If the die halves have a contact surface to accommodate the sheet to be formed, the forming of the sheet can be initiated early, such that in the first phase of forming, the sheet can be almost freely formed and large forming degrees can be attained.

The device according to the invention can attain a further advantageous embodiment in that the die halves are designed as hold-down elements, by means of which the sheet can be pressed against the punch during the forming process. During the forming process, for example during drawing, the sheet is drawn, by the pressing of the same perpendicular to the relative movement of the punch against the punch, without wall ironing and without a change of direction of the sheet, into the die. Preferably the die halves are moved in a force-controlled manner, such that the drawing process and the wall ironing ratio can be exactly controlled. The use of conventional hold-down elements is also conceivable, however, which exert force onto the sheet in the direction of movement of the punch.

If at least one further punch, movable perpendicular to the relative movement of the die halves and perpendicular to the longitudinal extension of the profile to be manufactured, is provided, additional forming processes can be carried out in one device. The forming of the profile is thereby rendered more flexible.

Further punch geometries can be provided in a particularly simple manner in that a follow-on compound punch is provided, which has at least two part punches. With the follow-on compound punch, the forming processes can be subdivided into different forming steps, and overall larger forming degrees and more substantial forming of the sheet can be achieved.

According to a further advantageous embodiment of the device according to the invention, a mould core and a mould core drawing device are provided, wherein the mould core is movable in the longitudinal direction of the profile to be manufactured using the mould drawing device and, together with or independently of the base plate, perpendicular to the longitudinal direction of the profile to be manufactured. Accordingly, during the forming of the sheet a mould core can also be used, wherein this is usually first introduced into the formed sheet after a first forming step, in which the sheet is drawn into a U-shape. Thanks to the use of the punch or, respectively, the follow-on compound punch for the forming of the sheet, the mould core can be of particularly simple design, since it does not necessarily have to fulfil additional embossing tasks.

It may also be advantageous, however, if the mould core has embossing and/or punching means, in order, for example, to form subsidiary formed elements into the profile to be manufactured. Subsidiary formed elements are, for example, holes, flanges, beading, etc.

A further embodiment of the device according to the invention has a slot-type punch, which is used in manufacturing longitudinal seam-welded profiles in order to precisely align the edges of the sheet which are to be welded. The slot-type punch can also have a plurality of thicknesses in the direction perpendicular to the edges which are to be welded, in order, for example, to carry out a calibration in a plurality of steps. This then guarantees that the edges which are to be welded are precisely aligned, and, by drawing the slot-type punch with simultaneous bringing together of the die halves, an optional zero joint gap can be set.

The economic advantage of the device according to the invention can be improved in that the device has at least two work stations, which are preferably arranged on an A-shaped frame. An A-shaped frame makes it possible on the one hand for the device to be operated from both sides, for example by removing the finished profiles. On the other hand, the hydraulics and control units used can be used for both work stations, such that the investment costs are reduced in respect of the throughput of the device. Due to the parallel processing of the individual steps for manufacturing profiles, cycle time advantages are achieved. For example, forming takes place in one work station, and welding is carried out simultaneously in the other work station. By using a single welding source, there is also a partial overlap of process times, by using two welding sources the process times for welding can be overlapped completely, such that parallel welding takes place.

Finally, a particularly high degree of flexibility can be achieved with regard to the performance of different forming processes in that the movement of the punch, the base plate, the die halves and optionally of the mould core can be controlled independently of one another. For this purpose, provision is made with the device, for example, for the use of hydraulic drives and a plurality of controlled axles, which provide high force, can be flexibly adapted to the structural form, and with which, by means of controllable axles, complex forming steps can be carried out relatively rapidly and precisely.

According to a second teaching of the present invention, the aspect described heretofore is achieved by a method for manufacturing a profile using the device according to the invention, wherein a sheet is laid onto or between the die halves of the device, preferably on contact surfaces provided for this purpose, a punch draws the sheet into the die of the base plate by a relative movement perpendicular to the closure movement of the die halves, and the die halves are closed during the drawing process of the punch, such that these press the sheet against the punch. By means of the method according to the invention, it is possible for the sheet to be stretched in the drawing direction only, without incurring a simultaneous change of direction due to the material entering the forming die, as is conventionally usual. In particular, material can in this way be processed with greater sensitivity, and substantial drawing depths can be achieved with controlled material wall ironing.

If, during the movement of the punch and the die halves, the base plate, together with the die contained within it, moves in concert at least relative to one of the die halves, perpendicular to the longitudinal direction of the profile to be manufactured, and perpendicular to the closure plane of the die halves, then a fixed die half can be used, and the costs for the device to be used can be reduced.

According to another, further developed embodiment of the method according to the invention, the punch is designed as a follow-on compound punch, and, after the drawing process of the first part punch, by the movement of the follow-on compound punch relative to the pre-formed profile, preferably by a movement perpendicular to the longitudinal direction of the profile, at least one further part punch with a different punch geometry is used and the forming of the sheet can be subdivided into a plurality of steps and greater forming degrees can be achieved. In particular, more complex shapings can also be achieved, since thanks to the additional punch geometry a further forming step of the sheet is made possible in the same device. Furthermore, it is also conceivable that more than two part punches can be provided in the follow-on compound punch.

In a simple manner, by a U-O forming process, a closed hollow profile can be provided in that, by using the follow-on compound punch, the sheet, pre-formed by the first part punch, is at least partially closed and optionally is welded using a welding device. At the end of the method there is accordingly a finish-welded, closed, and longitudinal seam-welded hollow profile provided. The closing of the pre-formed sheet to form a hollow profile is effected, for example, by a second part punch of the follow-on compound punch.

A calibration of the formed profile and the introduction of subsidiary form elements into the profile can be achieved in that, before closing the profile using the follow-on compound punch, a mould core is introduced into the pre-formed sheet using a mould core drawing device. As has already been described, additional embossing and/or punching means can be used via the mould core, and the profile can be provided with additional features.

As an alternative, a calibration is also possible without a mould core by pressing the die halves against the finished drawn-out or already welded profile.

BRIEF DESCRIPTION OF THE DRAWINGS

There are numerous embodiments of the device according to the invention and the method according to the invention for manufacturing profiles. In this respect, reference is made to the description of three embodiments in conjunction with the drawings. The drawings show in.

DETAILED DESCRIPTION

Figure 1:
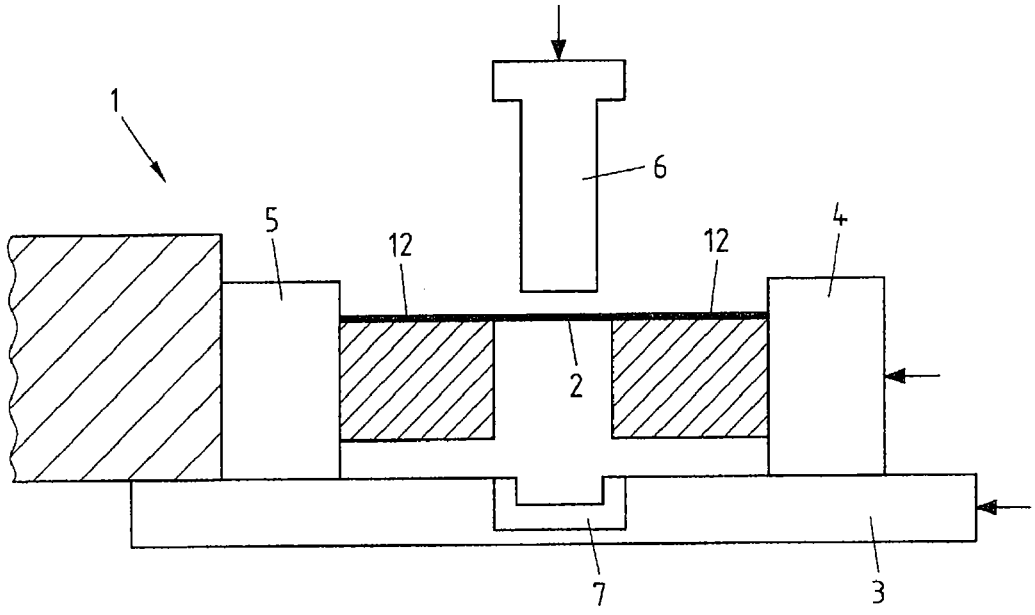
FIGS. 1 to 3 in a sectional view transverse to the longitudinal extension of the profile, a first embodiment of the device according to the invention, with a single punch, at three different points in time of the forming of the sheet, FIGS. 4 to 7 a second embodiment in a diagrammatic sectional view transverse to the longitudinal extension of the profile, with a follow-on compound punch, likewise at three different points in time of the forming of the sheet, and FIG. 8 in a diagrammatic sectional view likewise transverse to the longitudinal extension of the profile, a third embodiment of the device according to the invention with two work stations.
Figure 2:
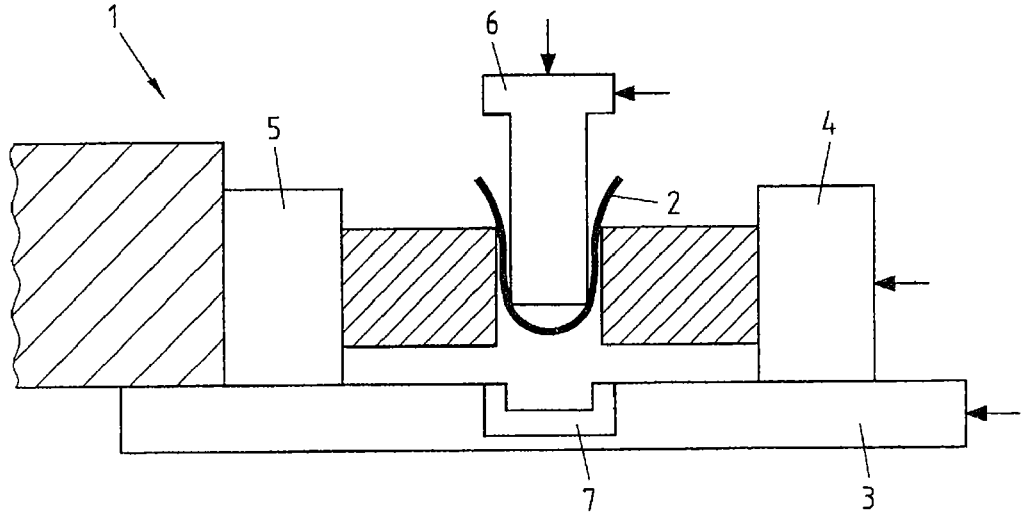

A first embodiment of a device 1 according to the invention, for manufacturing a profile, for example a half-shell from a sheet 2, which can also be a tailored blank, is shown in FIG. 1 in a diagrammatic sectional view transverse to the longitudinal extension of the sheet 2. The device 1 comprises a base plate 3 and two die halves 4 and 5. The die halves 4 and 5 are in their form adapted to the forming process which is to be used, or, respectively, in their shape to the component to be manufactured. Both die halves 4, 5, are movable perpendicular to the longitudinal extension of the profile to be manufactured, or, respectively, perpendicular to the longitudinal extension of the sheet 2 to be formed, relative to one another on the base plate 3. This also applies to the base plate 3, which is movable at least relative to one of the die halves perpendicular to the longitudinal extension of the sheet 2 and perpendicular to the direction of movement of the punch 6. In the present embodiment, the die half 5 is arranged fixed in position, and the base plate 3 and the die half 4 are moved relative to the die half 5. The drives for the die half 5, not shown here, can therefore be dispensed with. The punch 6, which is movable perpendicular to the relative movement of the die halves, is now used to form the sheet 2. In the first forming step, FIG. 2 shows that the sheet 2 is first formed in a controlled manner by the punch 6. During the forming, the die halves 4, the punch 6, and the base plate 3 are not moved in the direction of the die half 5, while the punch 6 carries out a movement perpendicular to the relative movement of the die half 4 and the base plate 3, in order to form the sheet 2 into the die 7. Basically, with the embodiments shown of the device according to the invention, there is however also the possibility of the base plate 3 moving in concert with the punch 6 during the forming. With an increasing forming degree of the sheet 2, the die halves 4 and 5 press the now already substantially formed sheet against the punch 6, and a controlled drawing of the sheet 2 takes place, without the sheet undergoing a substantial change of direction, as with traditional deep-drawing. As already indicated, the die halves 4, 5 are preferably force-controlled, such that the wall ironing ratio can be precisely adjusted.

Figure 3:
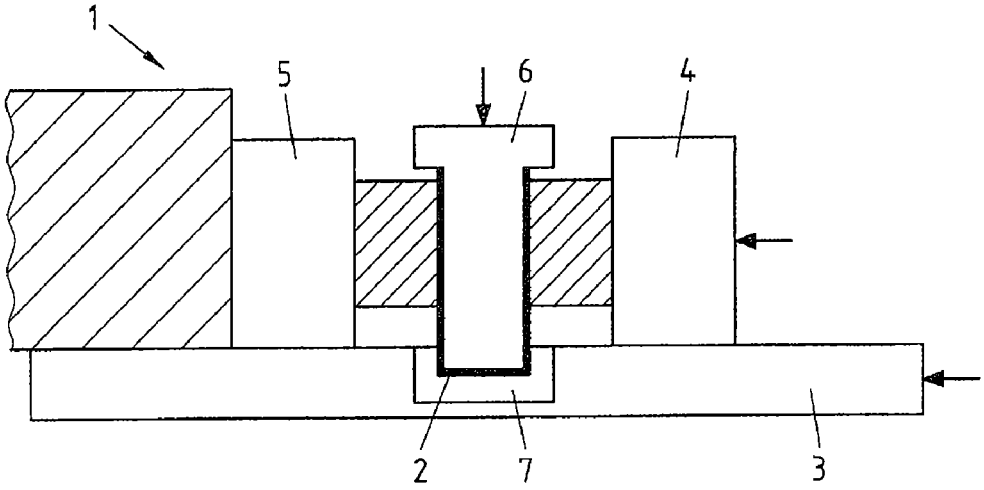

FIG. 3 now shows, in a diagrammatic sectional view, the first embodiment of the device according to the invention after the conclusion of the forming of the sheet 2 in the closed state. The die halves 4, 5 press the sheet 2 against the punch 6, and to this extent function as hold-down elements. By means of a force control of the die halves 4, 5, the wall ironing ratio of the sheet 2 can be precisely controlled.

Figure 4:
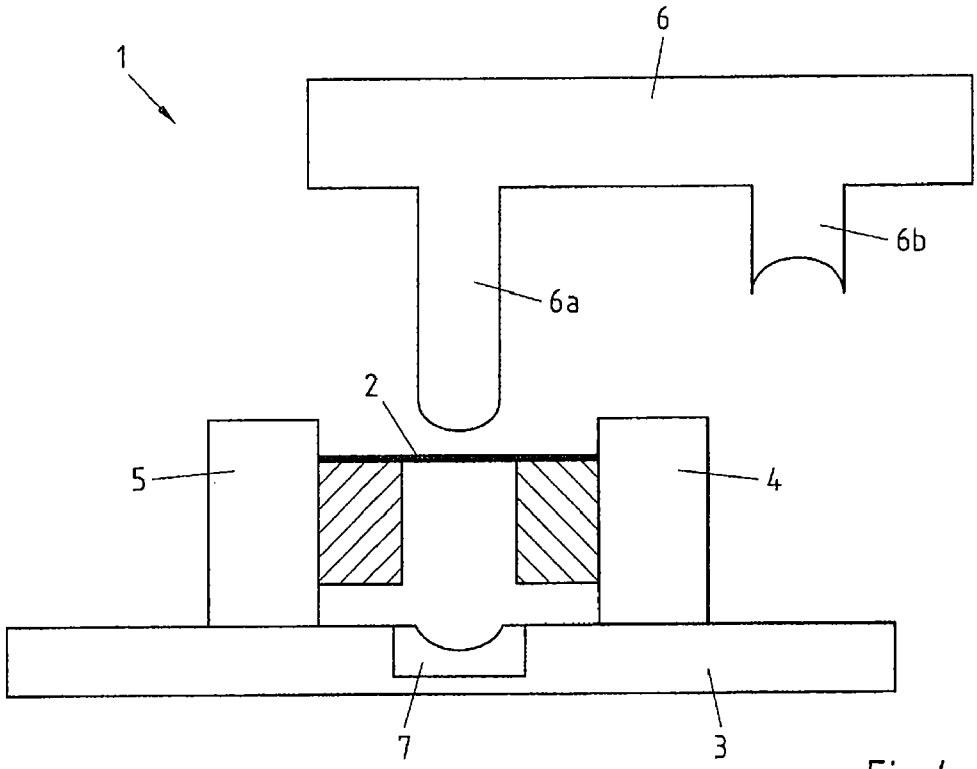
Figure 5:
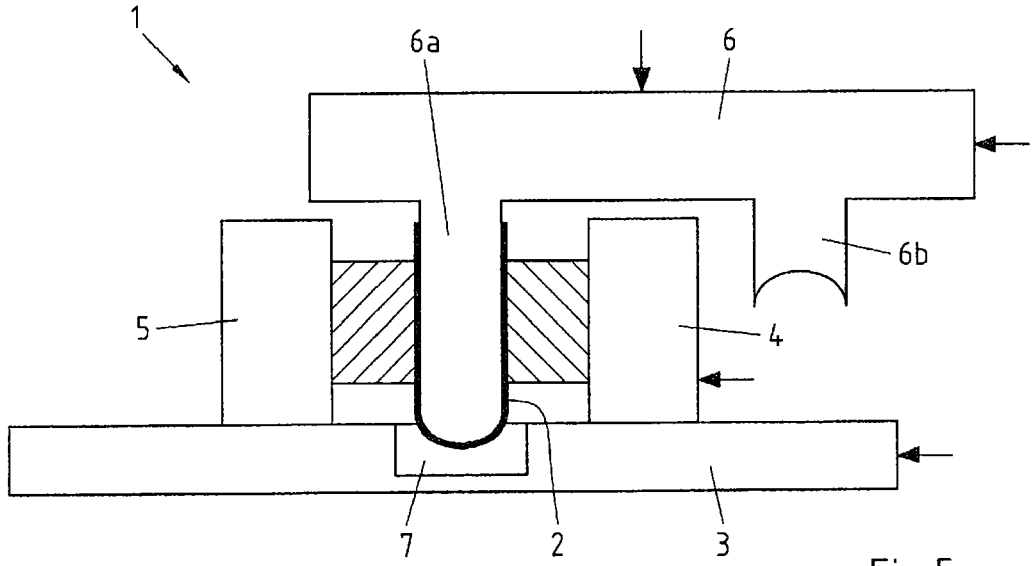
Figure 6:
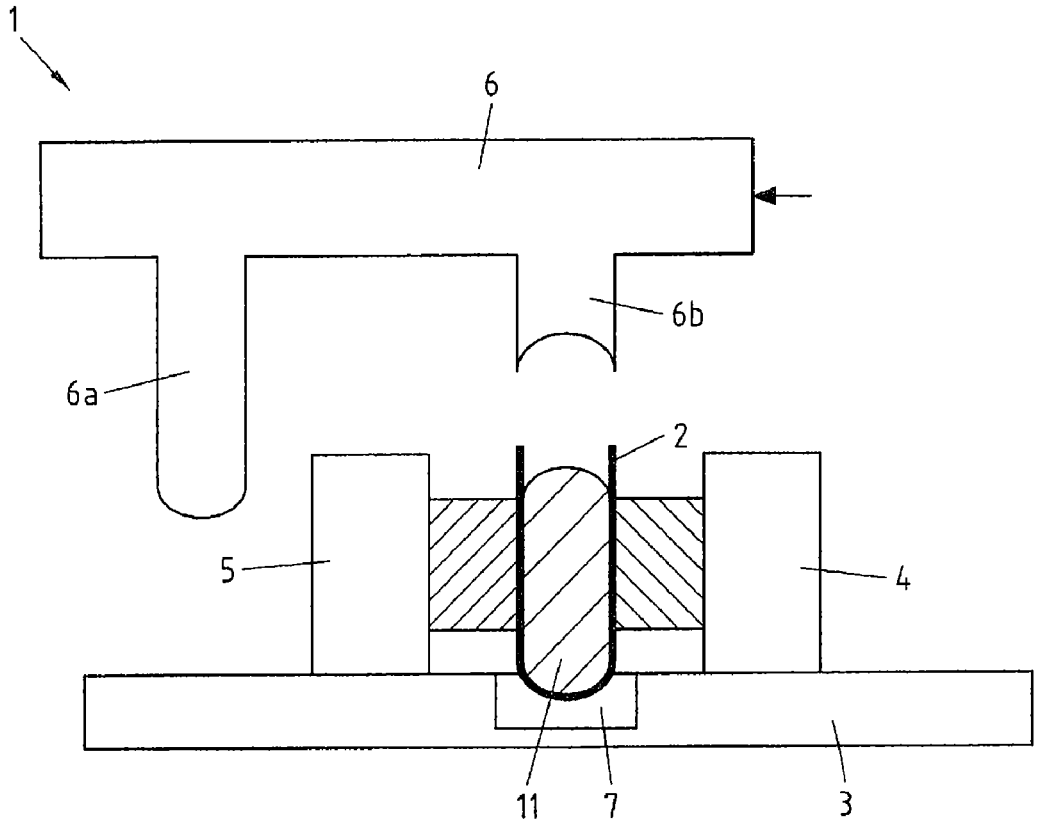
Figure 7:
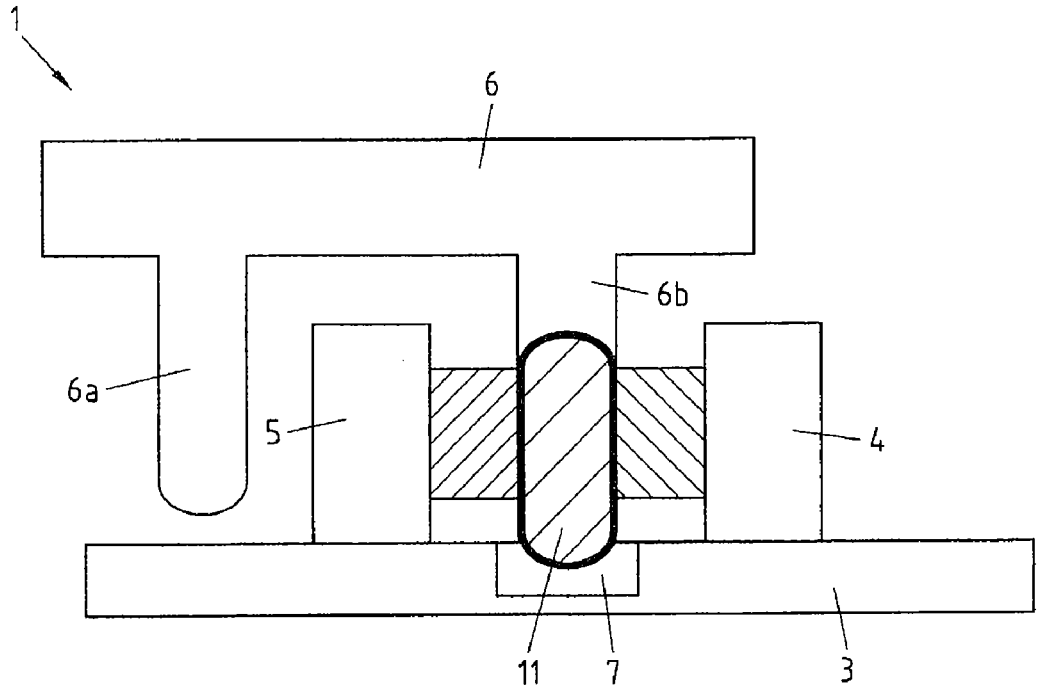

FIG. 4 shows, in an identical sectional view longitudinally to the extension of the sheet 2, a second embodiment of the device 1 according to the invention, with a follow-on compound punch 6. The follow-on compound punch 6 has two part punches 6*a*, 6*b* with different punch geometries, which are brought into use by displacement of the follow-on compound punch 6. In FIG. 4 the device 1 is first shown with a still unformed sheet 2. By contrast, in FIG. 5 it can be seen that the deep-drawing process for forming a U-shaped sheet 2 has already been completed. Here too, the die halves 4, 5, again serve as hold-down elements to achieve maximum drawing depths under controlled material wall ironing. Once the first forming has been completed, the follow-on compound punch 6 is moved further perpendicular to the longitudinal extension of the sheet 2, until the part punch 6*b* is arranged in the area of the formed sheet, FIG. 6. The part punch 6*b* is suitable, for example, for the U-shaped profile produced by the punch geometry of the part punch 6*a*, to be formed into a closed profile, in that the edges pointing upright of the formed sheet 2 are bent inwards. Preferably, before this, a mould core 11 is introduced into the pre-formed U-shaped sheet 2, in order to allow for the profile to be calibrated at the same time. This is shown by FIG. 7. The profile closed in this way is then welded along the longitudinal seam by a welding device, not shown, preferably by a laser welding device.

Figure 8:
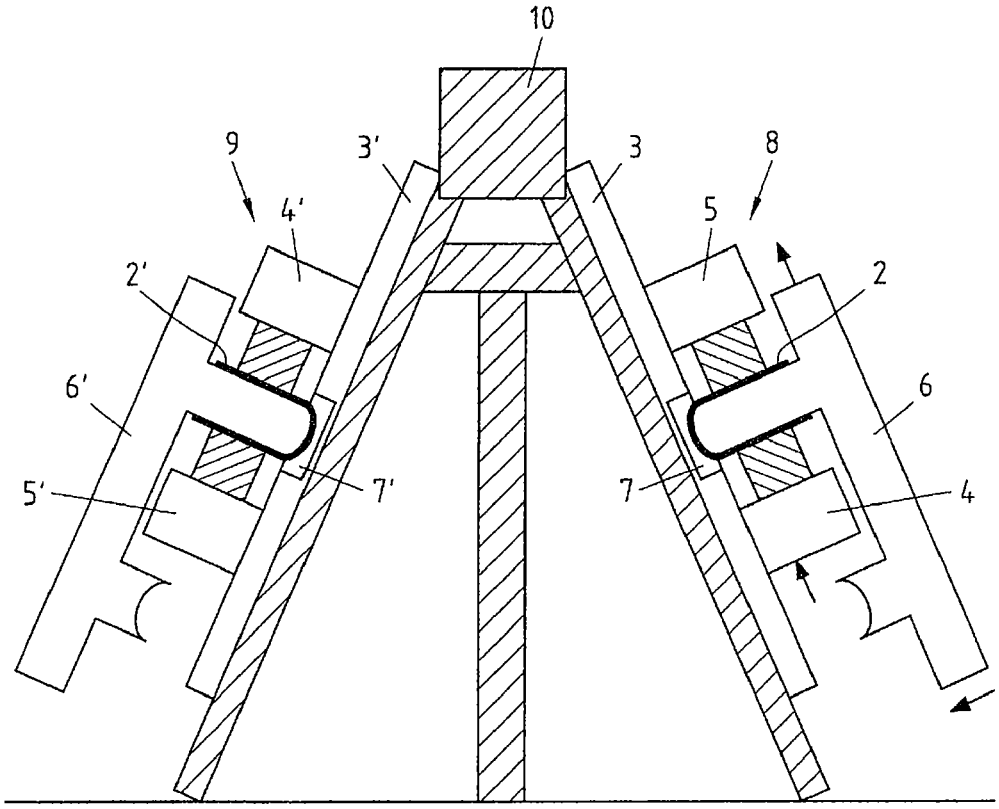

Finally, in FIG. 8 a third embodiment of the device according to the invention is shown, with two work stations 8 and 9, which are arranged on an A-shaped frame 10. The work stations 8 and 9 in each case comprise a device according to the invention, with two die halves 4, 4', 5, 5', a base plate 3, 3' with a die 7, 7', and a follow-on compound punch 6, 6'. The arrangement of the work stations on an A-shaped frame 10 is advantageous, since on the one hand it allows for a laser welding device, not shown, and hydraulic devices, not shown, to be used in common for both work stations. On the other hand, it is possible for the sheet which is to be formed to be laid in from two sides, or for the manufactured profile to be removed from both sides. Overall, this arrangement, through a space-saving layout, allows for a clear increase in throughput in manufacturing profiles, wherein the investments for this transpire to be comparatively low.

The invention claimed is:

1. Device for manufacturing profiles from a sheet comprising at least one work station with a base plate and two die halves, wherein the die halves and the base plate extend in the longitudinal direction of the profile to be manufactured, the die halves are arranged on the base plate movable relative to one another perpendicular to the longitudinal direction of the profile to be manufactured, a punch, movable perpendicular to the relative movement of the die halves and perpendicular to the longitudinal extension of the profile to be manufactured, is provided for forming the sheet, wherein the base plate, movable relative to the die halves, which base plate is movable perpendicular to the longitudinal direction of the sheet and perpendicular to the direction of movement of the punch, has a die adapted to the punch, in which die the sheet is formed, and the die of the base plate and the punch pertaining to it are exchangeable.

2. Device according to claim 1, wherein the base plate and at least one of the die halves is movable relative to one another and perpendicular to the longitudinal direction of the profile to be manufactured, and one of the two die halves is designed to be fixed in position.

3. Device according to claim 1, wherein the die halves have a contact surface to accommodate the sheet to be formed.

4. Device according to claim 1, wherein the die halves are designed as hold-down elements, by means of which the sheet can be pressed against the punch during the forming process.

5. Device according to claim 1, wherein at least one further punch, movable perpendicular to the relative movement of the die halves and perpendicular to the longitudinal extension of the profile to be manufactured, is provided.

6. Device according to claim 1, wherein a follow-on compound punch is provided, which has at least two part punches.

7. Device according to claim 1, wherein a mould core and a mould core drawing device are provided, wherein the mould core is movable in the longitudinal direction of the profile to be manufactured using the mould core drawing device and, together with or independently of the base plate, perpendicular to the longitudinal direction of the profile to be manufactured.

8. Device according to claim 7, wherein the mould core comprises embossing and/or punching means.

9. Device according to claim 7, wherein movements of the punch, the base plate, the die halves and of the mould core can be controlled independently of one another.

10. Device according to claim 1, wherein a slot-type punch is provided.

11. Device according to claim 1, wherein the device has at least two work stations.

12. Device according to claim 11, wherein at least one work station of the device has a welding device for the longitudinal seam welding of the profile.

13. Device according to claim 11, wherein the at least two work stations-are arranged on an A-shaped frame.

14. Device according to claim 1, wherein movements of the punch, the base plate, and the die halves can be controlled independently of one another.

15. Method for manufacturing a profile using a device according to claim 1, wherein a sheet is laid onto or between the die halves of the device, a punch draws the sheet into the die of the base plate by a relative movement perpendicular to the closure movement of the die halves, and the die halves are closed during the drawing process of the punch, such that these press the sheet against the punch in a force-controlled manner.

16. Method according to claim 15, wherein during the movement of the punch and the die halves, the base plate, together with the die contained within it, is moved in concert relative to one of the die halves, perpendicular to the longitudinal direction of the profile to be manufactured, and perpendicular to the closure plane of the die halves.

17. Method according to claim 15, wherein the punch of the device is designed as a follow-on compound punch, and, after the drawing process of the first part punch, by the movement of the follow-on compound punch relative to the pre-formed profile, at least one further part punch with another punch geometry is used.

18. Method according to claim 17, wherein using the follow-on compound punch, the sheet pre-formed by the first part punch is at least partially closed and optionally is welded using a welding device.

19. Method according to claim 17, wherein before closing the profile using the follow-on compound punch, a mould core is introduced into the pre-formed sheet using a mould core drawing device.

* * * * *